US007179145B2

(12) United States Patent
Driscoll et al.

(10) Patent No.: US 7,179,145 B2
(45) Date of Patent: Feb. 20, 2007

(54) DEPLOYABLE AND AUTONOMOUS MOORING SYSTEM

(75) Inventors: Frederick R. Driscoll, Pembroke Pines, FL (US); Thomas A. Pantelakis, Coral Springs, FL (US); Christophe Castanier, Corbeil Essonnes (FR); William A. Venezia, Boca Raton, FL (US)

(73) Assignee: Florida Atlantic Avenue, Boca Raton, FL (US)

( * ) Notice: Subject to any disclaimer, the term of this patent is extended or adjusted under 35 U.S.C. 154(b) by 0 days.

(21) Appl. No.: 10/772,479

(22) Filed: Feb. 5, 2004

(65) Prior Publication Data

US 2004/0229531 A1 Nov. 18, 2004

Related U.S. Application Data

(60) Provisional application No. 60/445,309, filed on Feb. 5, 2003.

(51) Int. Cl.
*B63B 22/04* (2006.01)
*B63B 22/18* (2006.01)
*B63B 22/22* (2006.01)

(52) U.S. Cl. ..... 441/7; 441/23; 441/30; 114/294

(58) Field of Classification Search ..... 441/1–3, 441/6–11, 21–33; 367/3–5; 114/307, 311, 114/294, 304, 305; 244/137.3, 138 A; 102/386–388, 102/390–392; 89/1.51
See application file for complete search history.

(56) References Cited

U.S. PATENT DOCUMENTS

| | | | | |
|---|---|---|---|---|
| 3,035,285 | A | 5/1962 | Squires, Jr. | |
| 3,291,092 | A * | 12/1966 | Halberg et al. | 114/295 |
| 4,216,535 | A | 8/1980 | Bennett | |
| 4,631,956 | A | 12/1986 | Walden et al. | |
| 5,735,719 | A | 4/1998 | Berg | |
| 6,093,069 | A | 7/2000 | Schelfhout | |

OTHER PUBLICATIONS

Driscoll et al., "A Combination Air Deceleration and Mooring Module for A-Sized Buoys," IEEE 1:433-440, 2002.

* cited by examiner

*Primary Examiner*—Ajay Vasudeva
(74) *Attorney, Agent, or Firm*—Akerman Senterfitt; Michael K. Dixon

(57) ABSTRACT

A self-mooring module. In particular, a self-mooring module that may be deployed by air, surface or underwater. The module includes a combination anchor/air brake, a buoy, and a mooring line. The module may also include a sensor module. The anchor, combination anchor/air brake and buoy may be used in combination as part of the module or may be used alone in different aspects. The anchor and combination anchor/air brake are foldable to conserve space. The buoy has reduced drag and increased stability versus regular buoys. The self-mooring module may also include an intelligent mooring line module that determines the amount of mooring line to be released for a particular mooring depth and does not release a substantive amount of extra or insufficient mooring line, thereby helping ensure proper placement of an sensor module. Other features include a release mechanism for releasing the anchor from the module and a mechanism for inflating the buoy.

20 Claims, 10 Drawing Sheets

DEPLOYABLE AND AUTONOMOUS MOORING SYSTEM

CROSS-REFERENCE TO RELATED APPLICATIONS

This Application claims priority to Provisional U.S. Patent Application No. 60/445,309, filed Feb. 5, 2003.

STATEMENT REGARDING FEDERALLY SPONSORED RESEARCH OR DEVELOPMENT

This invention was made with United States government support under grant number N00014-01-1-0014 awarded by the Office of Naval Research. The United States government may have certain rights in the invention.

BACKGROUND OF THE INVENTION

1. Field of the Invention

The present invention relates to the field of deployable systems and mooring systems, and more particularly, to the field of deployable autonomous mooring systems.

2. Description of the Related Art

In the last decade, interest in the ocean has shifted from the deep ocean to the littoral regions of the world. This change has been driven by the need to successfully operate in the complex littoral oceans that are characterized by intricate bottom topography, changes in water properties and time and spatially varying currents. The coupled effects of these characteristics create a complex environment for optical and acoustical transmission, vessel and AUV (autonomous underwater vehicle) operation, remote sensing as well as many other operations. Moored ocean buoys are an excellent platform to make coastal measurements to assess the littoral environment and to mount communication and positioning systems.

Although moorings are a proven technology, they have been developed for ship deployment with a focus on long term operation, access to large vessels and a large supply of energy. Thus, such systems are usually large; they have a large surface signature and require a surface vessel for deployment and servicing. The deployment, use and maintenance of such systems is impractical in a hostile theater far from the United States, where rapid deployment, low observability and autonomous operation are essential.

Air deployment provides a more rapid and less risky alternative to ship based deployment of moorings in hostile theaters. The "A"-sized form factor, 0.12 m (4.875 in) in diameter and 0.9 m (36 in) in length, is the standardized Navy dimension for rapidly deployable systems. The A-sized standard is adopted for many buoys used in ocean monitoring that are deployed from aircraft, helicopters, ships and submarines using pressure and gravity launch tubes, as well as charge-activated devices. However, an effective self-mooring system does not exist for an A-sized deployable system. Hence, the systems are typically left un-moored when they are deployed. In consequence, the systems may drift with ocean currents, tending to move ashore or out of the area of active interest. Accordingly, deployment of new systems is frequently required, leading to higher operating costs, and higher risks to Navy assets and personnel.

Although some deployable moorings do exist, they often exceed the "A"-sized dimensional standard. For example, a large deep-water oceanographic sensor system has been developed which has a length of 3.3 m, a diameter of 0.71 m diameter, and weighs 1100 kg. L. W. Bonde, et al., *Air Deployed Oceanographic Mooring—AB*1034, Proceedings Oceans 1993, vol. 1 at 237–50, 1993. Further, parachute entanglement is a common problem arising when mooring systems are air deployed. In particular, the parachute trails the system on a thin line. Upon air-sea penetration, the parachute may fall over the system, obstructing the deployment of sensors.

A recent air-deployable "A"-sized sonobuoy which includes an anchor that has been developed is the SSQ-57M, produced by Sparton Electronics of Deleon Springs, Fla. The sonobuoy is 0.57 m long and weighs 9.3 kg, and is intended for detecting underwater acoustical energy radiated by surface or subsurface vessels in shallow water. This system, however, is limited to a very short time of operation and deploys a fixed amount of mooring line.

Accordingly, the prior art solutions offer one or more problems with the different aspects of the device. In some instances, for a device deployed from the air, the parachute may interfere with the device upon deployment in the water. In other devices, the mooring line may not deploy properly, or this is an insufficient amount of line or an excess of line, thereby preventing the device from being properly moored. Also, in still other devices, the device may not be sized correctly to permit deployment from air, water and/or land. In yet other devices, the module may not be deployed correctly such that it may be used after deployment and/or may have to be replaced after a short period of time due to a short operating life. Also, in still other devices, the anchor may only work well in specific bottom types. In still other devices, the buoy may be forced under the water surface due to the design of the buoy and the strength of the current, thereby eliminating the advantage of using the module.

As such, what is needed is a deployable and autonomous mooring device that solves one or more of these problems. Additionally, what is needed is a device that incorporates one or more features such that the device may be used in a wide variety of locations and/or to deploy a wide variety of modules in an effective and dependable manner.

SUMMARY OF THE INVENTION

The present invention provides a deployable and autonomous mooring system that is capable of providing one or more advantages over prior art modules. In particular, the device of the present invention may utilize a parachute that enables the device to be deployed by air without interfering with the use of the device after the device has been deployed in water. The device of the present invention may also utilize an anchor that is constructed and arranged to occupy a minimal amount of space during deployment but is capable of effectively anchoring the module in water having strong currents in a range of bottom types. The device of the present invention may also utilize a mooring system that is constructed and arranged to moor a module in a beneficial position with regard to the surface of the water in a body of water having uncertain depth by supplying an amount of mooring line that is sufficient but not excessive or insufficient. The device of the present invention may also utilize a buoy that is constructed and arranged to remain above the surface of the water despite the strength of the current. The device of the present invention may also be sized accordingly to be used in a variety of deployment systems, but especially may be sized to be deployed in "A-sized" launch systems. Lastly, the present invention may be utilized in a variety of devices besides air deployment and autonomous mooring systems wherein the devices use one or more of the features in the deployment and autonomous mooring systems as necessary for the particular device.

In general, the present invention provides a deployable and autonomous mooring systems having a buoy, an anchor, and line(s) connecting the buoy to the anchor, and it may have a payload. In addition, the present invention provides an intelligent mooring line module for automatically determining the amount of line to be released such that the anchor is situated at the bottom of the body of water, the buoy is situated at the water surface, and not excess or insufficient line is released to interfere with the positioning of the buoy and/or that creates excess drag on the buoy and/or mooring line. The present invention also provides an anchor, a combination anchor/air brake, and a flotation buoy that may each be used in combination with one another as part of the deployable and autonomous mooring system of the present invention, or alone in various embodiments and alternative uses not related to the deployable and autonomous mooring system of the present invention. In addition the present invention provides a compact and/or inflatable buoy. As well, the invention also provides a release system that activates upon contact with, or submersion under, water. The present invention also provides for a mooring line with none, one, or more conductors.

In particular, in one embodiment, the present invention provides a deployable and autonomous mooring including a combination air brake/anchor comprising a plurality of mooring arms and a parachute attached to the plurality of mooring arms; a mooring line attached to the air brake/anchor; and a floatation buoy attached to an end of the mooring line.

In another embodiment, the present invention provides a buoy having a ratio of length to width of greater than about 2:1 thereby reducing drag on the buoy when placed in a body of water and/or having a shaped lateral cross-section such that, when the buoy is inflated with an inflation gas, a higher percentage of the volume is in an upper half of the buoy and a lower percentage of the volume in a lower half of the buoy.

In yet another embodiment, the present invention provides an anchor including a plurality of mooring arms; wherein the plurality of mooring arms includes a plurality of linked arm segments, the mooring arms being foldable at joints of the linked arm segments to enable the anchor to be folded into a compact, stowed position.

In still another embodiment, the present invention provides a combination anchor and air brake having a plurality of mooring arms; and a parachute attached to at least an end of a plurality of the mooring arms; wherein the plurality of mooring arms include a plurality of linked arm segments, the mooring arms being foldable at joints of the linked arm segments to enable the anchor to be folded into a compact, stowed position; further wherein a structure of the parachute in a deployed position is defined generally by a structure of the plurality of mooring arms in an extended position.

In yet another embodiment, the present invention provides a mooring module including a mooring line spool; a module housing; a mooring line; a line feed disk; and a line locking system, wherein the mooing line is fed out from the mooring line spool through the line feed disk.

In still another embodiment, the present invention provides a release mechanism for releasing an anchor attached to another device, which may be a sensor payload, and having a mooring release for releasing the anchor and mooring spool from the other device; and means for activating the mooring release upon contact with, or submersion under, water.

BRIEF DESCRIPTION OF THE DRAWINGS

There are shown in the drawings, embodiments which are presently contemplated, it being understood, however, that the invention is not limited to the precise arrangements and instrumentalities shown.

DETAILED DESCRIPTION OF THE INVENTION

Figure 1A:
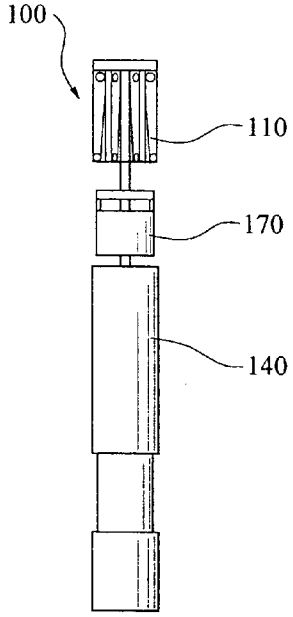
FIGS. 1A–1C provide illustrations of one embodiment of a self-mooring module of the present invention in three different operational stages.

The present invention is more particularly described in the following description and examples that are intended to be illustrative only since numerous modifications and variations therein will be apparent to those skilled in the art. As used in the specification and in the claims, the singular form "a," "an," and "the" may include plural referents unless the context clearly dictates otherwise. Also, as used in the specification and in the claims, the term "comprising" may include the embodiments "consisting of" and "consisting essentially of."

The present invention relates to a combination air brake/anchor, mooring system, and buoy packaged in a system that may be designed to conform to the "A-sized" buoy cylinder military standard, and is capable of deployment via air, water or land and/or autonomous mooring. The present invention may be designed such that it is one person portable. As such, the combined anchor, mooring module, and buoy is light enough to be carried by one person on a moving aircraft or ship. The device may also be designed to not exceed the standardized "A-size" diameter of 4.875 inches and 37 inches in length such that it can fit into a conventional launch container, such as the LAU-126/A. In a beneficial embodiment, the device may be designed such that it does not separate and/or deploy in the packaging launch tube. In alternative embodiments, the device may be designed to be released from the air (such as by aircraft (fixed and rotary wing)), the surface of the water or land (such as by boats or ground launch systems), underwater (such as by submarines), or by a person from a dock or on shore.

In alternative embodiments, the may be constructed and arranged such that it is capable of being launched using a pyrotechnic charge without damage to the device. Charge activated launchers are common and, to maximize system utility, in select embodiments, the anchor is designed to sustain high accelerations and large forces from conventional, as well as, other pyrotechnic launch systems. In additional embodiments, the device is designed to be deployable from aircraft traveling at any air speed and at any altitude. As such, the system would be able to be deployed at air speeds and altitudes that are consistent with coastal patrol aircraft, such as the P3 Orion, helicopters, jet aircraft, and other aircraft. Additionally, in other embodiments, the device is sufficiently strong to absorb the impulsive loads generated when the parachute deploys outside of the slipstream of the aircraft. Also, in select embodiments, the device may be constructed and arranged to automatically deploy a deceleration system (such as a parachute) without the aid of a string attached to the aircraft or a drogue parachute. This embodiment eliminates any long lines or other attachments that may entangle and lead to a more reliable and robust launch. In still other embodiments, the device has a maximum terminal velocity of 60 knots (30 m/s) as many air deployable packages are designed to sustain the impulsive load of a 60 knot (30 m/s) impact with the air-sea interface.

In use, the device of the present invention is designed such that it is capable of being launched from an aircraft or ship. After the device is launched from an aircraft or ship, an air brake/anchor is deployed, which acts as a parachute to slow the mooring device's fall and/or stabilizes the device through the air until the device enters water. While falling, the airbrake/anchor may be designed such that it is rigidly attached to the buoy, thereby helping to ensure robustness of the device while in the air. Upon penetration of an air-water interface, the device is designed such that a buoy is released from the device and inflated to become buoyant, while the air brake/anchor falls to the sea floor (or lake bottom, river bottom, and the like). Once on the sea floor, the air brake/anchor acts as an anchor to prevent the buoy from drifting with wind or ocean current, or other environmental disturbance. Although the present invention is described for exemplary purposes as being implemented for buoy deployment, the present invention is not so limited and other payloads may be deployed by the present invention in combination with or exclusive of the buoy. For example, the present invention may be used to deploy mines, sonobuoys, navigational aids, search and rescue markers, or any other object.

Accordingly, in one novel aspect of the present invention, the present invention includes an autonomous mooring module having a unique anchor. The anchor may be used alone, such as those instances when the unit is deployed at or near or under the surface of the water, or the anchor may be used in conjunction with an air brake, such as a parachute. In addition, based upon the novel and unique aspects of the anchor, the anchor and/or anchor/air brake combination may be used on its own as an anchor for surface vessels or underwater vehicle or as a sea anchor for various other devices.

The anchor of the present invention is designed to descend through the water at a speed such that the currents in the littoral regions, which are often strong, have less of an opportunity to move the instrument off the selected location. Oceans bottoms are diverse and can range from sand and mud to gravel and broken rock and, for maximum utility, the anchor is constructed and arranged such that it may fasten or remain stationary in any bottom type. Also, in select embodiments, the anchor is designed to remain fixed and support loads necessary to hold the entire package in currents up to 3 knots (1.5 m/s) in depths up to 600 ft (200 m). The anchor may also be designed for stronger currents and/or depths, though the resulting size and/or payload restrictions may not permit the overall device to be used in an "A" size system.

The anchor and parachute are apparatuses that support the deployment and placement of sensors in littoral or any other waters. Therefore, minimizing the mooring component size of these items provides more volume to be dedicated to mission specific hardware in those embodiments where the size of the overall device is important. However, conventional anchors tend to be large and poorly utilize space and parachutes are housed in separate modules. Thus, to minimize space, a compact combined parachute and anchor may be used in select embodiments. The combination air brake (parachute) and anchor includes one or more spring-load folding arms. In select embodiments, at least three arms are provided. In alternative embodiments, five arms are used.

Each of the arms has at least two linkages connected to each other. In select embodiments, there are three linkages. The linkages may be connected using any known connection means that enables the linkages to move with respect to each other including, but not limited to, pins and bolts, ball joints, bearings, bushings, or hinges. In addition, the linkages includes means for extending the linkages outwardly when the arm is free from any significant external force, thereby causing the arm to substantially straighten such that it may dig into the bottom of the body of water. These means may be, but not limited to springs, pistons, or electric actuators. The spring-loaded arms are connected to a central base and extend radially outward when deployed.

The anchor is made from a material that enables the anchor to perform the selected functions of the anchor. As such, the material is capable of withstanding any forces associated with anchoring, and/or any forces exerted by a parachute during opening, and/or any forces resulting during the descending of the device to the air-water surface, and/or the impulsive forces generated when the device impacts the air-sea interface. Additionally, in beneficial embodiments, the material is or materials are of a type that does not corrode, or corrodes very slowly, when immersed in water of various salinities. Finally, in beneficial embodiments, the material is one that has sufficient weight to sink to the bottom of the body of water to engage and anchor the device or any other vessel or system using the anchor. In select embodiments, the anchor is made from one or a combination of materials including, but not limited to, steel, aluminum, titanium, fiberglass, carbon fiber, and lead.

When used in conjunction with the anchor, a parachute may be attached to the anchor. The parachute may be attached to each arm of the anchor, or may be attached to select arms, and/or may be attached to the anchor shaft. The parachute may be attached using any known connection means, provided these means are strong enough to withstand the forces associated when the parachute opens and the resulting force on the rest of the device. One example of connecting means are fabric loops that are used at the middle and end of each arm to connect the parachute to the anchor. Additionally, means, such as cords, may be used for connecting the parachute to the main central column of the anchor.

As used in the self-mooring module of the present invention, the anchor includes the parachute for those embodiments that will be deployed via the air. For those embodiments where the device will be deployed at water level or underwater, such as when used to anchor a boat, submarine or other vessel, the parachute is not needed as an air brake but may be used to augment the anchoring abilities.

As such, during use either alone or in combination with the autonomous mooring system, the multi-arm claw anchor design exhibits exceptional holding ability in broken rock and reef and ease of packing it into a small volume. A low stiffness spring may be installed at the base of each arm to increase the holding ability of the claws. With the resulting arm compliance, the arms are able to conform to the bottom to maximize hold. In sand and mud bottoms, the arms are designed and positioned to dig in as the anchor is pulled. In such bottoms, the parachute and anchor arm combination provides the main holding. As the arms dig in, the parachute follows and fills with sand/mud, creating a large friction and/or gravity and/or suction anchor. The high fabric strength and/or tear resistance of the parachute prevents chafing and provides a long life for the anchor in soft bottoms. Thus, for this embodiment, the anchor is able to moor one or a combination of a surface buoy, or underwater buoy, instrument package, mine, vessel, or any other system in a wide range of bottom types.

Due to the impacts associated with opening the parachute during deployment and/or the possible use of the parachute as a means to collect sand or silt, it is beneficial for the parachute to be made from a high fabric strength and/or tear resistant material that is, in beneficial embodiments, also light in weight to help reduce the overall weight of the device. Examples of materials that may be used to construct the parachute include, but are not limited to, nylon, Kevlar®, and canvas.

When used in one embodiment of the deployable and autonomous mooring module of the present invention, the anchor arms may be folded and stowed below the mooring spool prior to deployment. When the package exits the launch tube, the springs force the mooring arms to open and, in one embodiment, an arm spreader guide is used to help prevent the arms from catching underneath the mooring spool. A bore in the arm spreader guide may be used to house a mooring line that connects the anchor to the mooring spool.

Parachute entanglement is a common problem arising when "A"-sized systems are air deployed—the parachute trails the system on a thin line and, upon air-sea penetration, it can fall over the system, obstructing the deployment of sensors. To eliminate this problem, the parachute-anchor assembly may be rigidly attached to the device of the present invention during air deployment and penetration through the air-water interface where the anchor arms may act to restrain the parachute and prevent it from covering the cylinder.

Once the air deployable and autonomous mooring module of the present invention breaks the air-water interface, the device is designed to release the clip between the anchor/air brake and the remainder of the device that holds them rigidly together. This may be accomplished by a release means for releasing the anchor/air brake upon contact with or submersion in water. In one embodiment, this means includes a chemical pill such that the water dissolves the chemical pill. At this point, a mooring release triggers, thereby releasing the anchor/air brake and/or the autonomous mooring module from the remainder of the system. Another embodiment may use a breakaway clip that breaks from the impact force of the air-water penetration and releases the anchor/air brake and/or the autonomous mooring module from the remainder of the system. Yet another embodiment may use wedges to attach the anchor to the remainder of the system for which the wedges are ejected by the impact force of the air-sea penetration.

A means, such as a compression ejection spring, may be used to help force the anchor from the mooring spool or the mooring line module. The anchor and the mooring spool may be connected by a mooring line, such as a steel line or other suitable line, and they sink, pulled down by the weight of the anchor. The mooring line housed within the mooring module is deployed as the module descends. The anchor contacts the bottom and moors the device. In other embodiments, the release mechanism may be selected from mechanisms including, but not limited to, electric mechanisms that release upon contact with the water or other chemical mechanisms that do not dissolve, but instead sense the properties in the water, such as ion concentration and/or temperature, and react thereto to cause the release mechanism to release the anchor.

As the release mechanism for the anchor/air brake is releasing the anchor, a second release mechanism is used to release a buoy. The buoy is used, in part, to help position the payload of the self-mooring module, such as a sensor module, in a predetermined location with respect to the air-water interface, i.e., the surface of the water. The second release mechanism, in some embodiments, may be the same one as the first release mechanism. However, in beneficial embodiments, the second release mechanism is a separate mechanism that causes the buoy to inflate or become buoyant upon contact with or submergence in the water. The second release mechanism may be of the same type as the anchor release mechanism. As such, in select embodiments, the second release mechanism is a chemical pill that dissolves upon contact with the water. When the chemical pill dissolves, an inflation mechanism is activated that causes inflation of the buoy, such as with a compressed gas cartridge having compressed air or compressed carbon dioxide ($CO_2$) or any other compressed gas, that inflates the buoy, thereby forcing the buoy to the surface of the water. As it ascends, and the rest of the package descends, a mooring line and wires connecting the buoy to the payload and anchor system may be fed out from a channel in the side of a pressure case.

In one embodiment of the deployable and autonomous mooring module of the present invention, the sensor module (or payload) may be used to mount instruments for communication, positioning, environmental measurements, navigation, identification, and/or tracking. As such, it is beneficial that the payload be properly positioned in the water. However, in those environments having strong winds and/or current, this may be difficult if the buoy is forced under water due to drag on the buoy, which may also cause extreme tension on the line connecting the buoy to the payload causing the buoy to break away and the payload to sink. Additionally, if any antenna is located on the buoy for transmitting information, drag on the buoy may cause the antenna to be submerged or positioned in a manner that does not permit the antenna to function properly. As such, the shape of the surface buoy may be altered as conventional surface buoys often contribute the majority of the drag acting on the overall system. Alteration of the shape also helps to increase the system stability of any antennas that are penetrating the air-sea interface.

As such, in beneficial embodiments, the buoy has a streamlined horizontal cross section that orients the buoy into a current and minimizes its drag. In other embodiments, the buoy has a lateral cross section that is shaped to provide vertical stability and a positive rate of buoyancy and/or righting moment increase with increasing submergence.

In regards to the horizontal-cross section, it is contemplated that the width of the buoy is less than the length of the buoy. As such, when contacted with a current, the current will have a greater surface area of contact along the length of the buoy, forcing the buoy to turn into the direction of the current, thereby cutting down the drag on the buoy. As such, in one embodiment, the buoy has a ratio of length to width that is from at least about 2 to about 1. In another embodiment, the buoy has a ratio of length to width that is from at least about 3 to about 1. In still another embodiment, the buoy has a ratio of length to width that is from at least about 4 to about 1. Ratios of less than about 2 to about 1 may be used in other embodiments, though these ratios may not be beneficial for high current deployments. The use of these ratios significantly reduces drag on the buoy when compared to standard cylindrical buoys. Finally, it is contemplated that the buoy may have a varying width in relation to the length to form a shape that further reduces the drag. For example, in one embodiment, the buoy may be shaped such that it has a triangular cross-section when viewed above such that, in use, the water currents force the buoy to orient such that the point of the buoy faces the current, with width of the buoy increasing from the tip, but still such that the width of the buoy is less than the length.

In regards to the lateral cross-section that is shaped, the buoy is designed to provide a higher percentage of the inflation gas, such as air or $CO_2$, in the upper half of the buoy and a lower percentage of the inflation gas in the lower half of the buoy. In one embodiment, this may be accomplished by using a buoy having a triangular-shaped lateral cross-section. As such, when in the water, as a higher percentage of the inflation gas is in the upper half of the buoy, the buoy is more difficult to submerge, especially when the buoy has a reduced drag associated with the horizontal cross-section. Other shaped lateral cross-sections may be used in lieu of a triangular shape including, but not limited to, trapezoidal, egg, and balloon shapes. In select embodiments, the lateral cross-section may be in the shape of a right triangle.

In addition, in alternative embodiments, the buoy may include a stabilization and vortex reducing means after the buoy has been inflated to help position the buoy into the current and help the buoy maintain this positioning. As such, the stabilization and vortex reducing means would include any such means capable of performing this function. In select embodiments, the stabilization means is a flexible flap or "rudder" that is attached to the buoy on a plane substantially parallel to the plane of the current into which the buoy is positioned. Upon inflation, the flap or "rudder" helps adjust the buoy into the current by providing additional area for the current to contact, thereby helping to push the buoy and orient it into the current, thereby reducing the drag on the buoy. The flap or "rudder" may also act to prevent vortexes from being shed by the buoy, thereby, reducing the drag.

As a result of the unique shape of the buoy of the present invention, the buoy has significantly reduced drag as compared to conventional buoys. For example, in one embodiment, the buoy has a drag that is less than about 50% of the drag for a buoy having a circular cross-section. In another embodiment, the buoy has a drag that is less than about 35% of the drag for a buoy having a circular cross-section. In still another embodiment, the buoy has a drag that is less than about 20% of the drag for a buoy having a circular cross-section. As such, the buoy may be used in alternative embodiments that do not involve the use of the autonomous mooring module of the present invention. For example, in one embodiment, the buoy may be used to surface platform to mount sensors (oceanographic, acoustic, optical, biohazard, atmospheric etc) navigational aid search and rescue maker/platform sensor target (radar, sonar, visual, etc). The buoy may also be used in other embodiments that are not inflating but have rigid form, including, but not limited to steel, foam (including syntactic foam), and aluminum buoys.

When the buoy is used as part of the autonomous mooring module of the present invention, the buoy is connected to the payload using wires. These wires are then connected to the buoy and the buoy includes any applicable antennas or the like for sending and receiving signals and measurements taken from the payload. These antenna(e) may include, but are not limited to, global positioning system (GPS), radio frequency (RF), satellite, and a combination thereof.

The payload module is connected to the buoy by a predetermined length of cables, lines, and/or wires such that the payload is positioned at an approximate depth in the water. As the types of payloads that may be used are vast in number, the exact location will vary upon the intended use and a non-fixed length of cables, lines, and/or wires may also be used. In addition, the particular components included in the payload may vary. However, depending on the intended use, the payload may include one or more of the following components including, but not limited to, electronics, power supplies, modems, sensing devices, sampling devices, traps, and a combination thereof.

Accordingly, once the self-mooring module has entered the water, the buoy inflates and the anchor/air brake descends to the bottom. The sensor module or payload is positioned at an approximate depth below the buoy. The payload may also connect to a mooring line module that is connected to the anchor. One of the novel features of the present invention is that the payload is positioned at a depth and position and the payload maintains substantially this position as the mooring line module releases an amount of mooring line sufficient to anchor the payload but that is not substantially in excess or insufficient, which would allow the payload to float with the buoy. This is accomplished by using an intelligent mooring spool that determines the depth of the water and only releases enough mooring line to ensure the payload anchors and does not release an excess or deficiency of mooring line.

In one aspect of the present invention, a mooring module may be provided. The mooring module may also be rigidly attached to the air brake/anchor during the fall to the water and released from the air brake/anchor as or after the air-water interface is reached. The mooring module may connect to the buoy and/or the payload with at least one mooring line (buoy mooring line) and connect to the air brake/anchor with at least a second mooring line (anchor mooring line). In particular, the mooring line module may release an optimal amount of buoy mooring line (and/or anchor mooring line) until an optimal mooring line length is reached for buoy deployment, at which time a mooring line spool within the mooring line module may be locked to prevent further mooring line from being released.

Mooring a buoy properly is accomplished by choosing the scope of the mooring line (ratio of mooring line length to water depth) such that it balances the size of the watch circle (a circle centered at the anchor that encompasses the horizontal travel extents of the surface buoy) and the line tension because a shorter mooring line reduces the watch circle but increases the line tension in a current. Since littoral areas may be defined as coastal regions with a varying water and may also be characterized by time and/or spatially varying currents, in beneficial embodiments, the deployable mooring has an autonomously adjustable mooring scope to maximize the flexibility of deployment.

Controlling mooring line from the surface requires a relatively expensive, high power, and bulky depth sensor to measure water depths questionable performance in aerated stormy seas. As such, the mooring module of the present invention uses a sinking autonomous intelligent mooring spool. The spool is connected to the anchor by a section of mooring line. The mooring module includes a depth sensor. In beneficial embodiments, the sensor uses low amounts of power and is compact. The mooring spool houses and deploys the mooring line. By measuring the length of mooring line deployed and the depth, the module is able to lock the mooring line at an optimum scope, depending on the depth of the water.

As in the parachute-anchor design, miniaturization is beneficial. As such, in select embodiments, an electro mechanical design is used. Other embodiments may be micro mechanical or micro electrical alone. This mooring module includes a module housing, mooring line spool, a line feed mechanism, a means for determining the amount of line to be released, and a line locking mechanism. In one embodiment, the line locking mechanism is a solenoid, while other embodiments may include, but are not limited to, one or a combination of bi-stable mechanisms, pistons, rotary mechanism, magnetics, and linear actuators The mooring line is fed out from a spool that may be fixed or may rotate. The line is fed from one end of the mooring module through a line feed that either rotates (if the spool is fixed) or is fixed (if the spool rotates). In beneficial embodiments, the spool is fixed and the line feed rotates and two miniature thrust bearings are used to support the rotating line feed and they reduce system friction so that mooring line may be pulled out with a low amount of line tension, such as about one pound. The fixed mooring spool does not use slip rings as it is capable of supporting a mooring line with conductors. Slip rings are used in those embodiments using a rotating spool. In alternative embodiments, the present invention is capable of passing the mooring line around radiused corners to reduce stress on the mooring line and conductors. In other embodiments, the mooring line may be spooled on the inside of housing and can be pulled out without the use of a line feed disk.

In addition to using the mooring module in the deployable and autonomous mooring module of the present invention, the mooring module may also be used for other purposes including, but not limited to, autonomous anchoring of surface and subsurface buoys and vessels deployment of power and communications cables.

Also, the self-mooring module device of the present invention may be used in other sizes besides "A" size and for other purposes other than mooring instruments in littoral waters. For example, the device may be used as a self mooring platform for deployment of sensors (oceanographic, acoustic, optical, biohazard, atmospheric, etc.); search and rescue marker/platform; or as a sensor target (radar, sonar, visual, etc.).

Figure 1B:
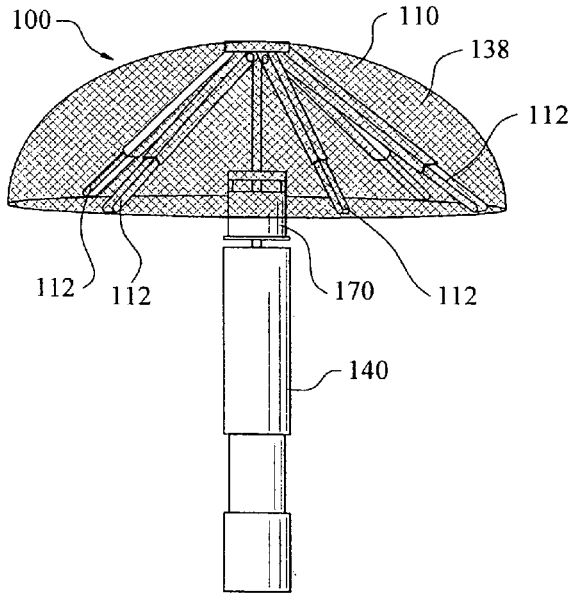
Figure 1C:
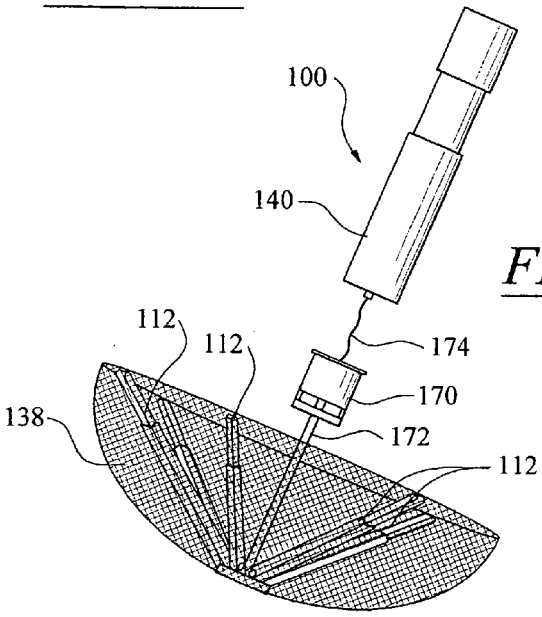

Reference is now made with specific detail to the drawings in which like reference numerals designate like or equivalent elements throughout the several views, and initially to FIGS. 1A–1C, in which a mooring system 100 is depicted which includes an air brake/anchor 110, a flotation buoy 140 and a mooring line module 170. In FIG. 1A, the mooring system 100 is depicted in a first operational state wherein the air brake/anchor 110 is in a compact stowed position and the buoy 140 and mooring line module 170 are attached to the air brake/anchor 110. This configuration simplifies air deployment and eliminates potentially troublesome parachute entanglement issues. In the first operational state, the mooring system 100 may be stored into a conventional "A-size" buoy deployment cylinder (not shown) or may be sized as necessary to fit other size cylinders. As known to those of ordinary skill in the art, when launched from an aircraft or vessel, the buoy deployment cylinder may be fed into a deployment tube and locked in place. A pyrotechnic charge may be used to deploy the mooring system 100 from the aircraft, leaving the buoy deployment cylinder behind, attached to the aircraft (or vessel).

Referring to FIG. 1B, the mooring system 100 is depicted in a second operational state wherein the air brake/anchor 110, buoy 140 and mooring line module 170 are deployed from the cylinder and the air brake/anchor 110 is in an expanded operational position to effectuate air braking during a fall to the air-water interface. In particular, the air brake/anchor 110 may include a plurality of mooring arms 112 which may be released from a folded position to an extended position upon deployment. A parachute 138 may be attached to the mooring arms 112 to effectuate air braking as the mooring system 100 falls to the water. In the deployed position, the shape of the parachute may be defined generally by the structure of the mooring arms in the extended position. In this operational state, the air brake/anchor may be rigidly attached to the buoy and the mooring line module.

FIG. 1C depicts the mooring system 100 in a third operational state after the mooring system 100 has entered the water. After the mooring system 100 has entered the water, the buoy 140 and mooring line module 170 may be released from the rigid attachment to the air brake/anchor 110. Further, the buoy 140 may be inflated to enable the buoy to become buoyant. The weight of the air brake/anchor 110 will cause the air brake/anchor 110 to sink to the sea floor, while the buoyancy of the buoy 140 will cause the buoy to float upward from the air brake/anchor 110. At least one anchor mooring line 172 may keep the mooring line module 170 flexibly attached to the air brake/anchor 110. Further, at least one buoy mooring line 174 may keep the buoy 140 flexibly attached to the mooring line module 170. In select embodiments, the mooring lines 172, 174 are wear resistant and corrosion resistant cables.

Figure 2:
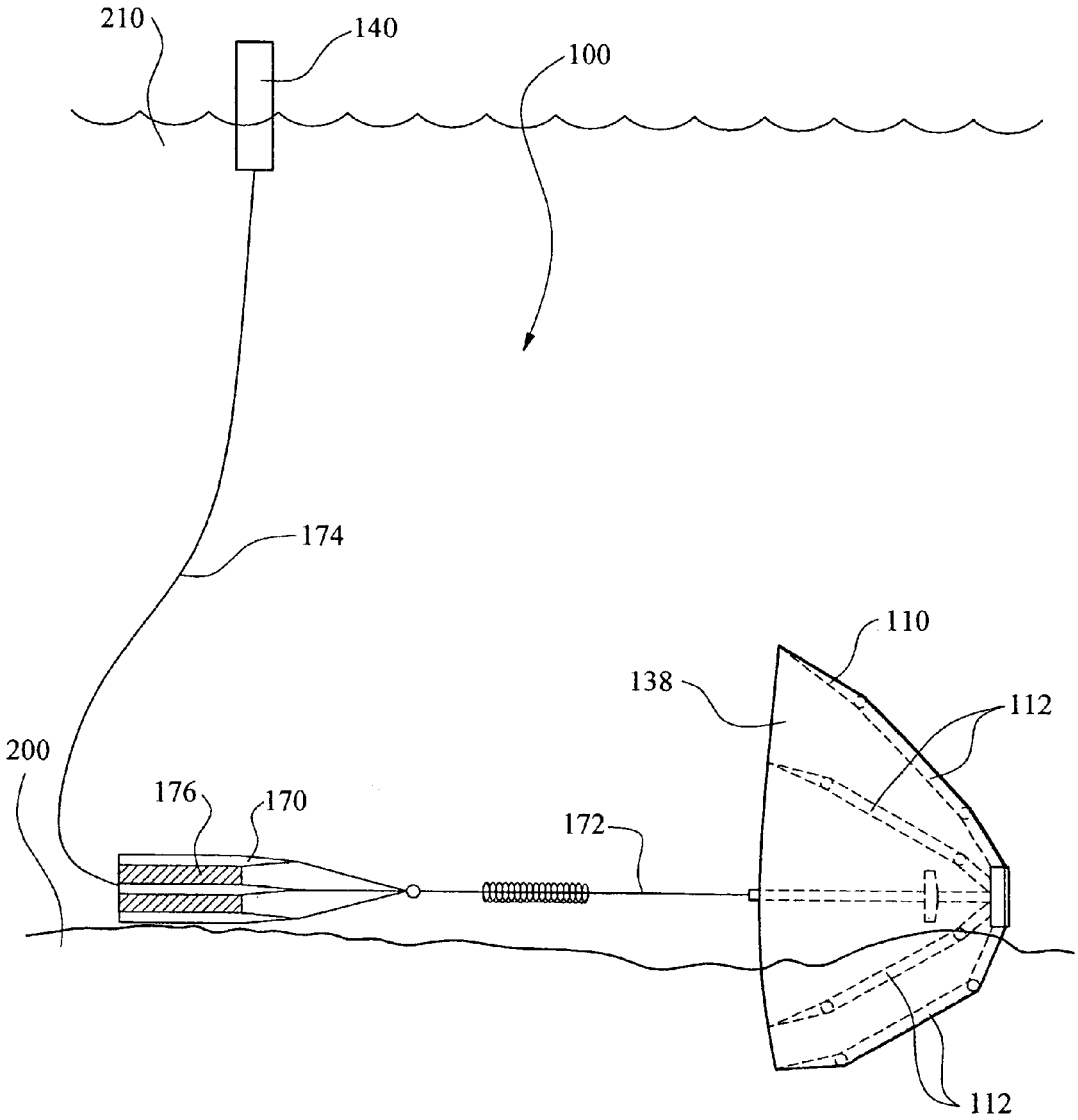
FIG. 2 is a perspective view of a self-mooring module according to one embodiment of the present invention after deployment in a body of water.

FIG. 2 depicts the mooring system 100 after the air brake/anchor 110 has settled to the sea floor 200 and the mooring lines 172, 174 have been released. The air brake/anchor 110 design is particularly well suited to quickly fill with sand, gravel and/or mud after reaching the sea floor 200. In such bottoms, the mooring arms 112 may conform to the bottom to maximize hold. Further, the parachute 138 provides extra holding power. As the mooring arms 112 dig in to the sea floor 200, the parachute 138 follows and fills with sand, gravel and/or mud, creating a large friction/gravity anchor. Hence, in beneficial embodiments, the parachute 138 be made of a fabric which is strong and tear resistant to prevent chafing and provide a long life for the anchor in soft bottoms. Furthermore, the design of the mooring arms 112 exhibit exceptional holding power in broken rocks and reefs.

In the arrangement shown, the anchor mooring line 172 is a fixed length and the length of the buoy mooring line 174 may be adjustable. For instance, the buoy mooring line 174 may be wound around a mooring spool 176 within the mooring line module 170 prior to deployment, and released as required from the mooring spool 176 during deployment. Notably, the amount of the buoy mooring line 174 which is released from the mooring spool 176 may be selectable so that the buoy 140 may be positioned anywhere from the sea floor 200 to the water surface 210. For example, the buoy 140 may be deployed to float on the water surface 210, or to float below the water surface 210.

Figure 3:
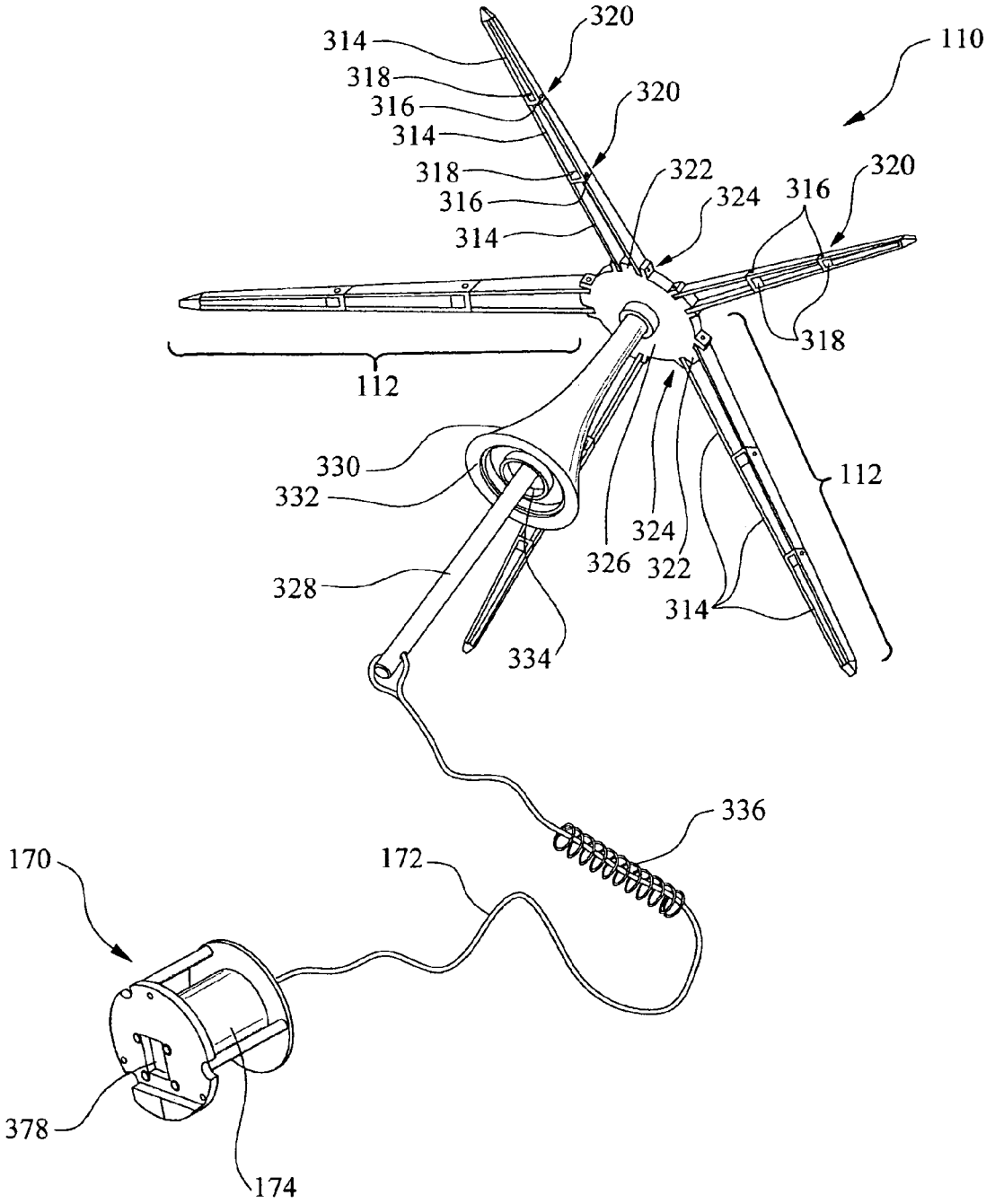
FIG. 3 is a perspective view of one embodiment of an anchor in accordance with the inventive arrangements disclosed herein.
Figure 4:
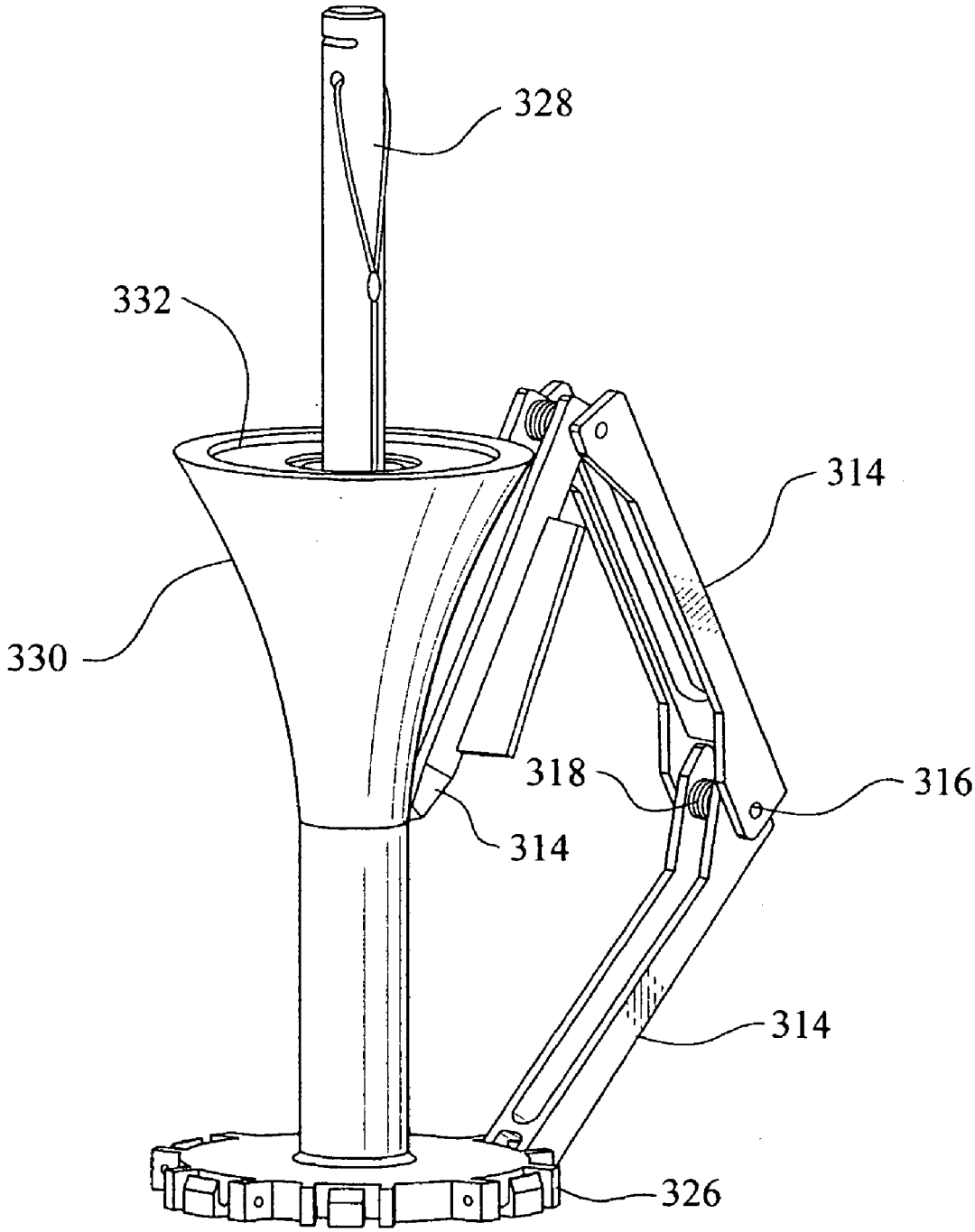
FIG. 4 is a perspective view of one embodiment of a folding arm portion of an anchor in accordance with the inventive arrangements disclosed herein.

Referring to FIG. 3, a deployed air brake/anchor 110 (without the parachute) and a deployed mooring line module 170 are shown. The air brake/anchor 110 is a claw anchor design, which exhibits exceptional holding ability in broken rock and reef. Further, the design of the air brake/anchor 110 facilitates the packing of the air brake/anchor 110 into a small volume. Each mooring arm 112 comprises a plurality of arm sections 314 (examples of which are shown in greater detail in FIG. 4) that fold together to form a small package.

Adjacent arm sections 314 may be attached such that they swivel, for example using pins 316. Further, torsion springs 318 may be disposed at the joints 320 formed by adjacent mooring arm sections 314. Further, torsion springs 322 may be disposed at joints 324 between mooring arms 112 and a central base 326. The torsion springs 318, 322 may provide the necessary force to initiate arm deployment radially outward from the central base 326 once the mooring system 100 is dropped from an aircraft. Once arm deployment begins, the parachute 138 may fill with air and pull the mooring arms 112 into a position of full extension. Notably, selecting the torsion springs 322 to be low stiffness increases the holding ability of the air brake/anchor 110 when anchored on the sea floor.

The air brake/anchor also may include an anchor shaft 328 and an ejection guide 330. The anchor shaft 328 may be inserted into an aperture 378 within the mooring line module 170. The ejection guide 330 may be attached to the anchor shaft to guide the mooring arms 112 during deployment and eliminate the arms from catching on the mooring line spool. When deployed, the weight of the ejection guide may help to keep the anchor shaft horizontal on the sea floor to maximize anchoring effectiveness. The ejection guide 330 may have a conically shaped outer lower surface 332 to house the anchor mooring line 172. Further, the ejection guide 330 may have a recess 334 in an inner lower surface to receive a release spring 336, that may be used to release the mooring line module 170 from the air brake/anchor 110 when the mooring system has entered the water.

Figure 5A:
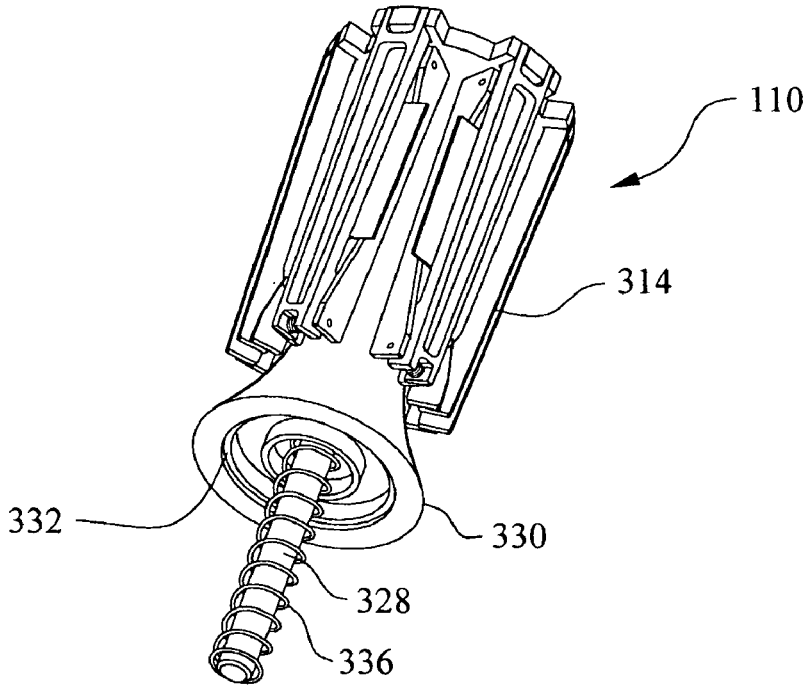
FIGS. 5A–5B depict one embodiment of an anchor as folded prior to deployment either alone (FIG. 5A) or in combination with a self-mooring module (FIG. 5B).
Figure 5B:
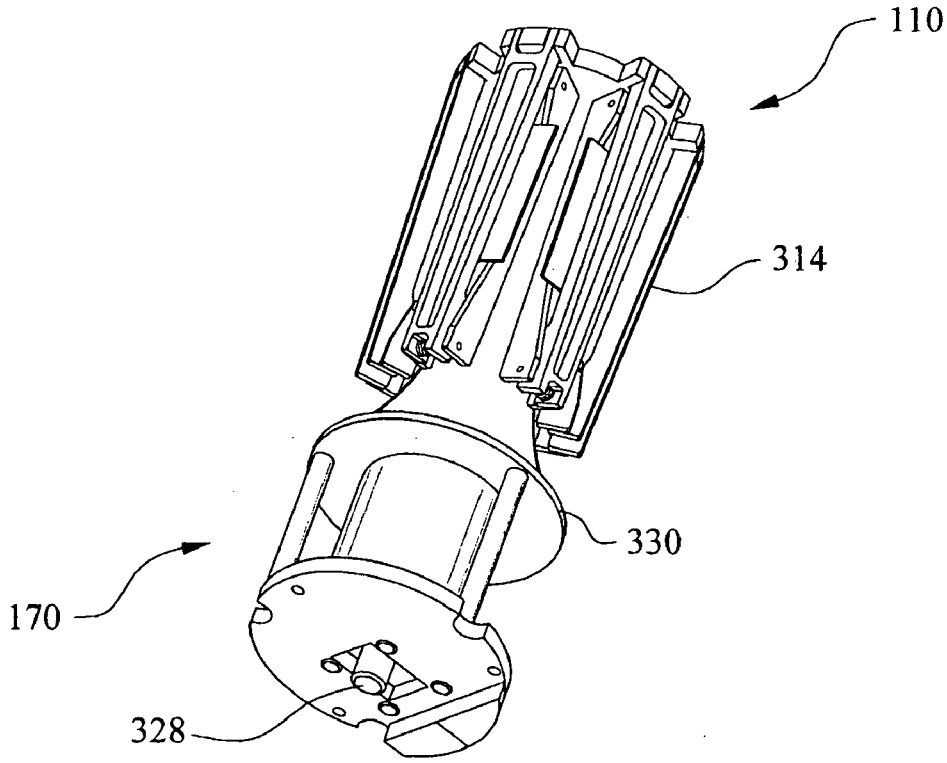

The air brake/anchor 110 (without a parachute) and mooring line module 170 are shown in a compact assembled position in FIGS. 5A and 5B. When fully assembled, the anchor shaft 328 passes through the mooring line module and attaches to a payload, such as a sensor module and/or buoy. The release spring is compressed within the ejection guide 330 pushes against the mooring line module 170, thus compressing the mooring line module 170 between the payload and the air brake/anchor 110, thereby loading the anchor shaft 328 in tension. To help keep the system together, a set of pins (not shown) are mounted to the payload to penetrate the end of the anchor shaft 170. A bi-stable mechanism (not shown) may be used to release the pins quickly and reliability. When the pins are released, the compression spring pushes the air brake/anchor 110 from the mooring line module 170 and pulls the anchor shaft 328 from the payload and out of the mooring line module 170. As noted, the air brake/anchor 110, mooring line module 170 and payload are then physically separated, only connected by buoy mooring line 174.

Figure 6:
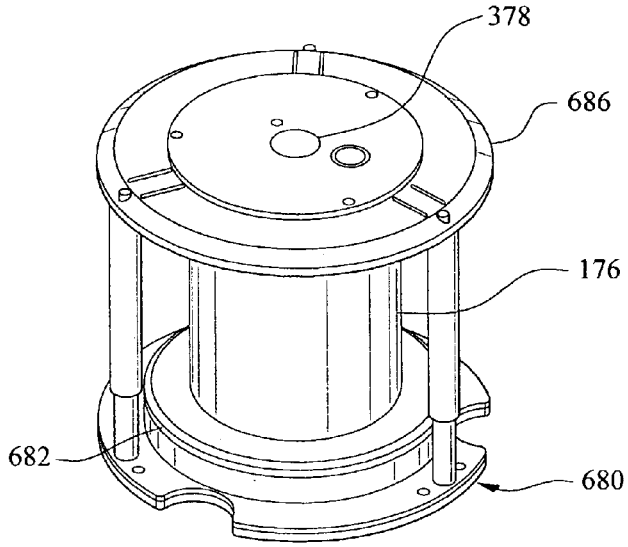
FIG. 6 depicts an enlarged view of a mooring line module according to one embodiment of the present invention.
Figure 7:
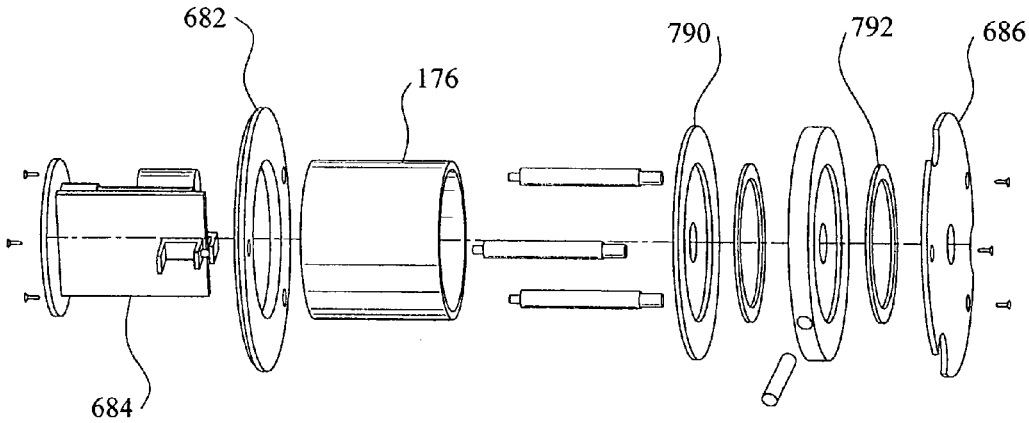
FIG. 7 depicts an exploded view of mechanical components of a mooring line module according to one embodiment of the present invention.

FIG. 6 depicts an enlarged view of one embodiment of a mooring line module 170 (without the buoy mooring line) and FIG. 7 depicts separate mechanical components of this embodiment of a mooring line module. The mooring line module 170 houses and deploys the buoy mooring line and self-locks at preprogrammed scopes at any depth supported by the amount of mooring line (different size modules may contain different lengths of mooring line). The mooring line module 170 includes a mooring line spool 176, a module housing 680, a rotating line feed disk 682, an electronics board 684, and a line locking mechanism. In operation, the mooring line may be fed out from the mooring line spool 176 through the rotating line feed disk 682, then out of the top 686 of the mooring line spool 176. A large miniature thrust bearing 790 and a small miniature thrust bearing 792 may be used to support the rotating line feed disk 682 as the disk rotates while buoy mooring line is released from the mooring line module 170. The thrust bearings 790, 792 also may reduce system friction so that the buoy mooring line may be pulled from the mooring line module 170 with little line tension.

Figure 8A:
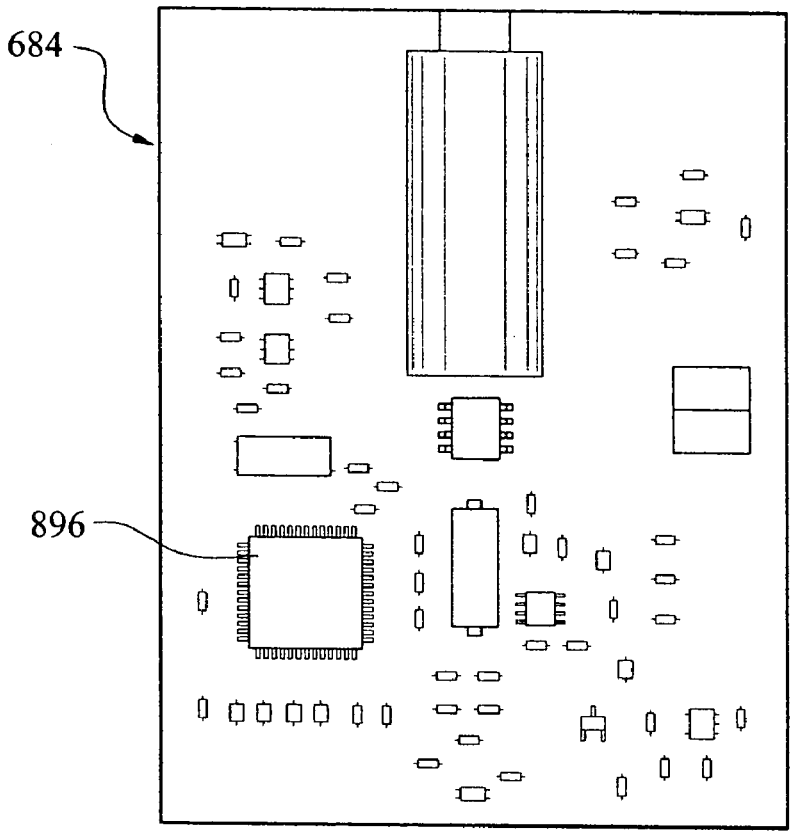
FIGS. 8A and 8B show an electronic board and power supply according on one embodiment of a mooring line module of the present invention.
Figure 8B:
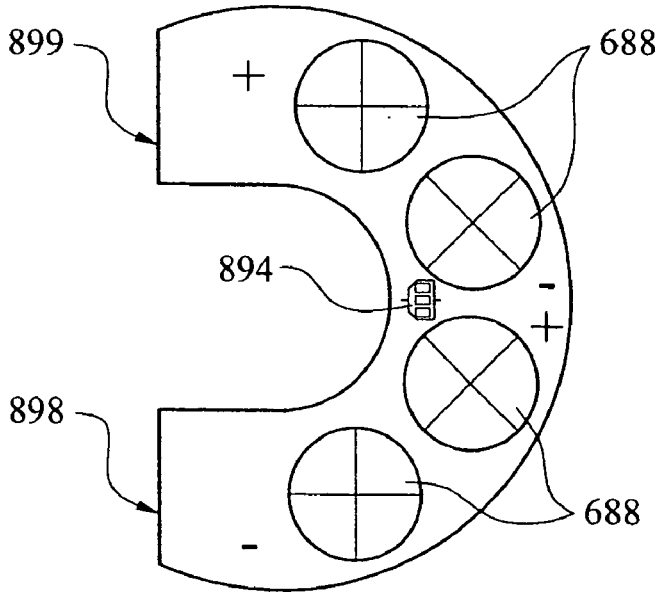

As noted, in one embodiment, the amount of buoy mooring line that is deployed may be measured using a magnet imbedded into the rotating line feed disk 682 and a hall sensor, which may be attached to the electronics board 684. Additionally, referring to FIGS. 8A and 8B, as buoy mooring line is pulled out, the rotating line feed disk 682 rotates one turn for each wrap of mooring line wound on the mooring line spool 176. Hall senor 894 may detect the movement of the magnet (not shown) past the hall sensor for each rotation. Each wrap of buoy mooring line that is deployed may be counted an onboard processor 896, which may calculate the amount of buoy mooring line which is fed using any method that would be known to the skilled artisan, for example a calibrated table of turns-to-line length.

The electronics board 684 may include a power source 686, such as a battery or plurality of batteries 688. The batteries may be N-sized alkaline batteries (shown) or any other type of battery that may fit on the board and be capable of performing as a power source for the present invention.

A pressure sensor (not shown) may provide a measure of depth for the mooring line module 170. The pressure sensor may send signals representing pressure readings to the electronics board 684 via pressure sensor connector 898. Once the correct amount of buoy mooring line has been deployed for the measured depth, a solenoid (not shown) may be activated and locks the rotating spool and the mooring line. The electronics board 684 may activate the solenoid via solenoid connector 899. The solenoid may be retracted to release additional buoy mooring line if the module slips into deeper water or as a method of reducing line wear at friction points. Notably, this method of locking the line does not require the buoy mooring line to be pinched. Moreover, there is an extremely low probability of the buoy mooring line slipping using the mooring line module 170 as presently described.

Figure 9:
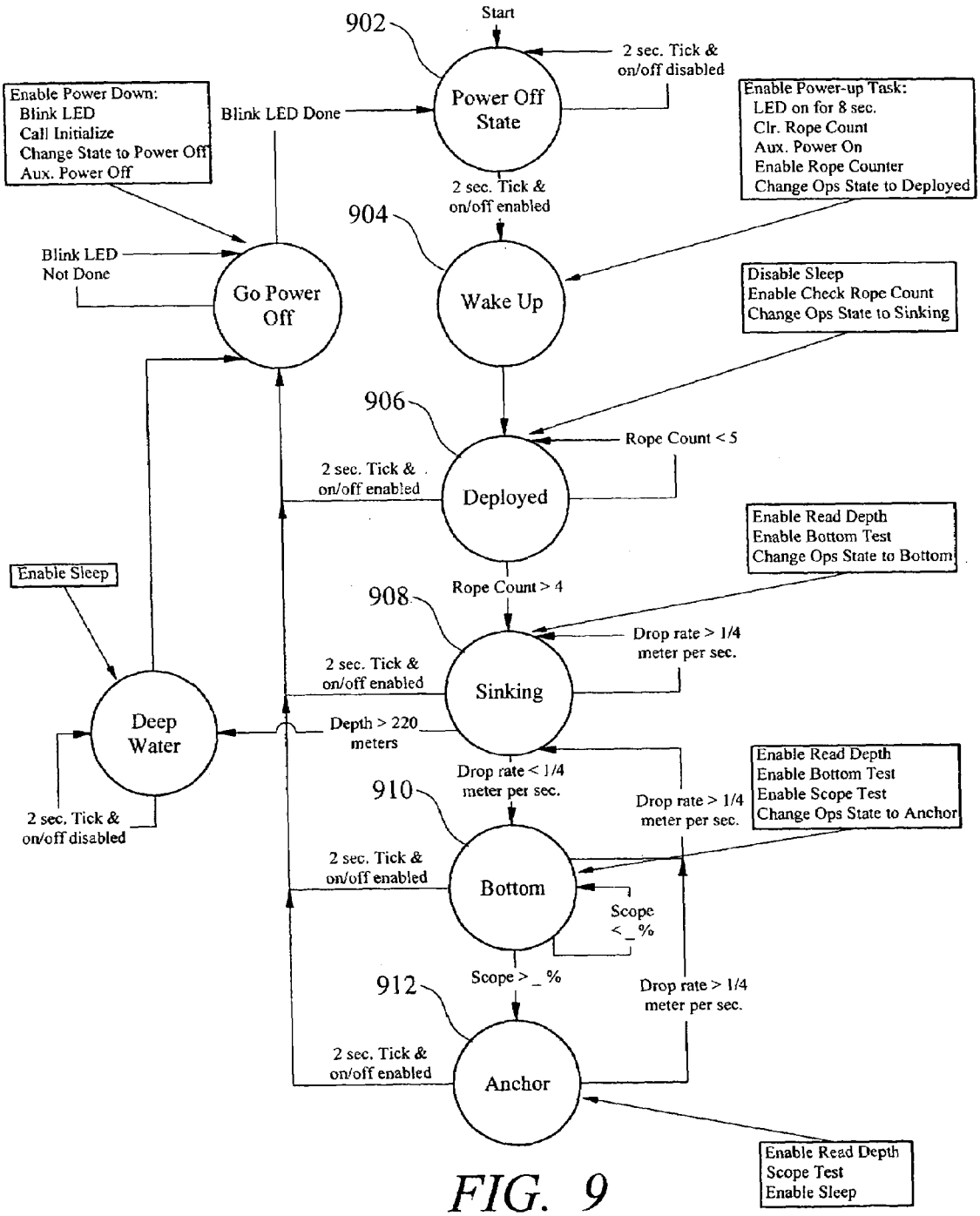
FIG. 9 is a flow chart representing mooring line module operation according to one embodiment of the present invention.

Referring to FIG. 9, a flow chart 900 representing one embodiment of mooring line module 170 operation. Referring to step 902, once batteries are connected to the unit it may initialize all registers and sets the System State to Power OFF. A two second interval timer that generates an interrupt and becomes the System Tick also may be activated. The on/off hall sensor may be monitored on each tick and if the sensor is energized with an external magnet the System State may be changed to Wakeup, as shown in step 904. The LED then may flash for eight seconds to indicate that the unit is ready to deploy. If the batteries are low, the LED may blink four times and the unit may go back to the Power Off State. Upon a useful power up, the System State may be changed to Deployed, as shown in step 906, with the Rope Hall Sensor counter interrupts enabled. To save power, the unit may sleep when not interrupted until the count reaches five (5) (approximately 0.3 m of line deployed), at which moment the System State may be change to Sinking, as shown in step 908. In Power OFF State, the system may have a shelf life exceeding five years.

In the Sinking State, it may be beneficial that the unit does sleep, and the pressure sensor may be powered up. Each time a System Tick accrues, the pressure sensor may read and calculate the depth of the mooring line module. Only when the rate of fall is less then ¼ meter per second, the system has stopped descending, does the System State change. This prevents the solenoid from energizing and wasting battery power. When the rate of change falls below ¼ meter per second the System State changes to Bottom.

Referring to step 910, in the Bottom State, the required scope may be calculated each time a System Tick accrues. Note that if the rate of fall becomes greater then ¼ meter per second, the System State may drop back to the Sinking State. When the scope reaches the required amount, the solenoid may be energized to lock the mooring line from unwinding. The System State then may change to Anchor, as shown in step 912. If the fall rate becomes greater then ¼ meter per second, the System State may drop back to the Sinking State. The scope may continue to be check and be adjusted by activating the solenoid as required. Note, in any state, the unit may be turned off and on with the On/Off Hall Sensor. This enables system testing and debugging.

Figure 10:
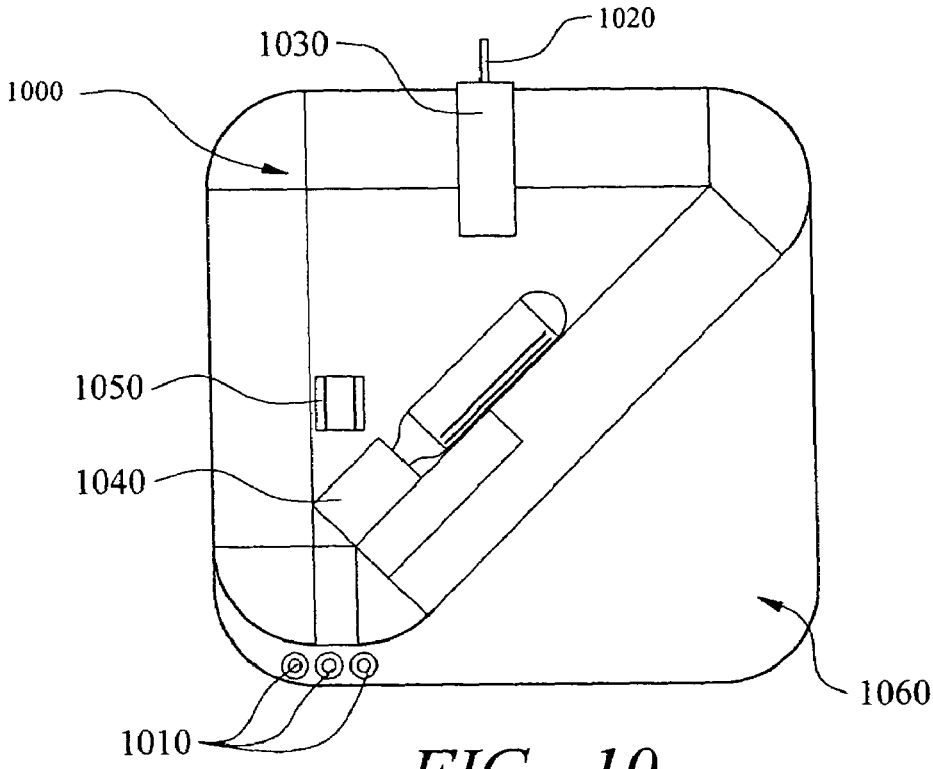
FIG. 10 is a side view of one embodiment of a buoy in accordance with the inventive arrangements disclosed herein.

FIG. 10 provides a side view of a flotation buoy 1000 in accordance with one embodiment of the present invention. As can be seen, the buoy 1000 has a width less than the length and a shaped lateral cross-section (a right triangle in this embodiment). The buoy 1000 also includes wires and grommets 1010 for connecting to a sensor module (not shown) and connected to an antenna 1020. The wires 1010 and/or antenna 1020 may include GPS and/or RF modems and systems. A strap 1030 may be used to keep the antenna 1020 in place. The buoy 1000 also includes the inflation mechanism 1040 (shown in greater detail in FIG. 11). Attachment loops 1050 may also be included. Finally, in select embodiments, a vortex dampener 1060 may be included as well for stabilizing the buoy 1000.

Figure 11:
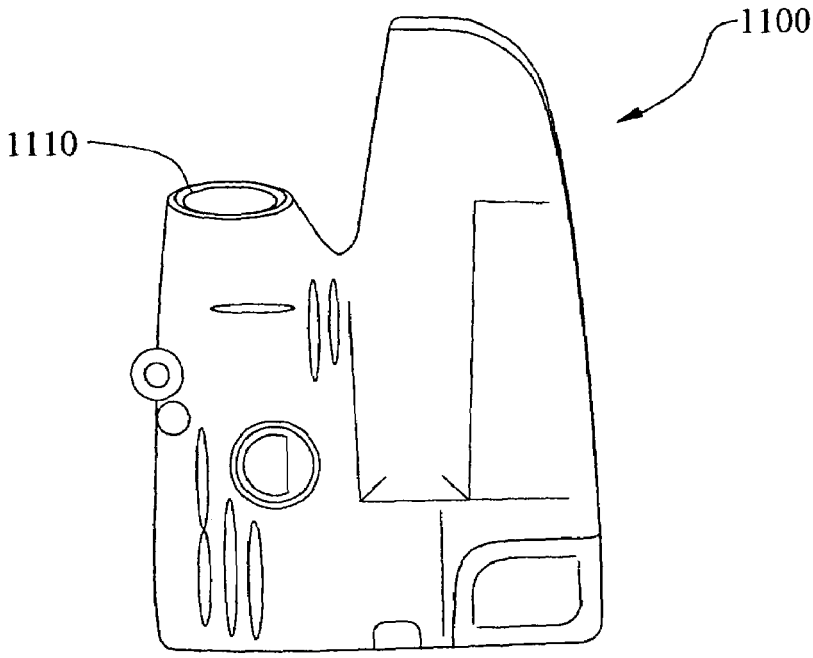
FIG. 11 is a perspective view of one embodiment of a means for inflating a buoy in accordance with the inventive arrangements disclosed herein.

FIG. 11 is a perspective view of one embodiment of a means for inflating a buoy in accordance with the inventive arrangements disclosed herein. This particular embodiment depicts a means for inflating a buoy that may be obtained from Lifesaving Systems Corp. (Apollo Beach, Fla.). In this embodiment, the means 1100 includes an opening 1110 for holding a compressed gas cartridge, such as a $CO_2$ cartridge.

Figure 12A:
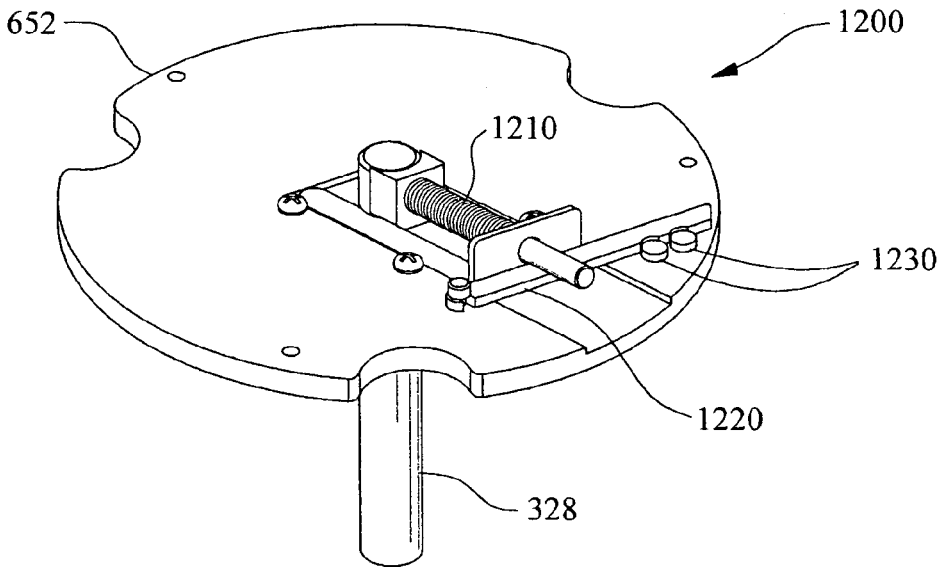
FIG. 12A is a perspective view of one embodiment of a release mechanism for releasing an anchor in accordance with the inventive arrangements disclosed herein prior to the release mechanism contacting water.
Figure 12B:
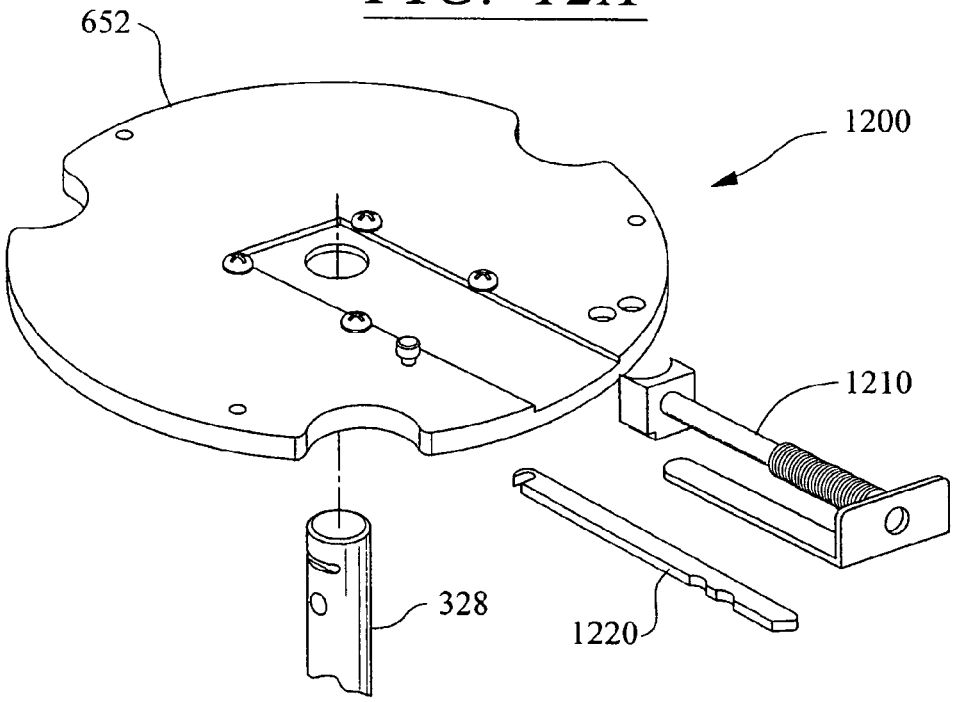
FIG. 12B is a perspective view of one embodiment of a release mechanism for releasing an anchor in accordance with the inventive arrangements disclosed herein after the release mechanism has contacted water.

FIG. 12A is a perspective view of one embodiment of a release mechanism 1200 for releasing an anchor in accordance with the inventive arrangements disclosed herein prior to the release mechanism contacting water. The mechanism 1200 includes a spring loaded release 1210 that connects the anchor shaft 328 to the bottom 682 of the mooring module. The release 1210 is held in place using a lever 1220 and two chemical pills 1230. When the mechanism 1200 contacts water, the chemical pills 1230 dissolve, thereby permitting the lever 1220 to move due to the force exerted thereon by the spring release 1210. At this time, the anchor shaft 328 is able to break the rigid attachment to the bottom 682 of the mooring module, thereby permitting the anchor to release and sink to the bottom 200 of the water.

Although the illustrative embodiments of the present disclosure have been described herein with reference to the accompanying drawings and examples, it is to be understood that the disclosure is not limited to those precise embodiments, and various other changes and modifications may be affected therein by one skilled in the art without departing from the scope of spirit of the disclosure. All such changes and modifications are intended to be included within the scope of the disclosure as defined by the appended claims.

What is claimed is:

1. An autonomous mooring device comprising:

an anchor comprising a plurality of mooring arms rotatably coupled to a body of the anchor and biased to extend radially outward upon deployment from a deployment chamber above a sea floor and wherein the autonomous mooring device is separated from the deployment chamber upon deployment;

a mooring line module including the at least one mooring line coupling the mooring line module to the anchor;

wherein the body of the anchor is coupled in close proximity to the mooring line module such that the plurality of arms may be rotated into a position in which the autonomous mooring device, including the plurality of arms, may be stored in the deployment chamber and upon release from the deployment chamber above the bottom, rotate the mooring arms into a position such that the arms extend radially;

a release mechanism in communication with the anchor, wherein the release mechanism is configured to release the anchor from attachment in close proximity to the mooring line module upon contact with a water surface, whereby the anchor remains in contact with the mooring line module via the at least one mooring line;

a flexible parachute coupled to the plurality of arms and extending between the arms at least partially circumferentially around the anchor to form a parachute usable to reduce the velocity of the autonomous mooring device after being dropped in air above a water body; and a buoy in communication with the mooring line module.

2. The mooring device of claim 1, wherein the mooring device is operable between a plurality of operational states comprising:

a first operational state wherein the anchor is a stowed position, and the anchor, the mooring line module and the buoy in a deflated state, are capable of being contained within a cylinder;

a second operational state wherein the anchor, the mooring module and the buoy are deployed from the cylinder, the anchor, mooring line module and buoy are all rigidly attached, and the anchor is in an expanded operational position to effectuate air braking; and a third operational state wherein the anchor, mooring module and buoy are deployed, further wherein the buoy is attached to the mooring module including a first cable and the mooring module is attached to the anchor including a second cable, and the buoy is inflated to be buoyant.

3. The mooring device of claim 1, wherein each of the mooring arms comprise a plurality of linked arm segments, the mooring arms being foldable at joints of the linked arm segments to enable the anchor to be folded into a stowed position.

4. The mooring device of claim 3, wherein the mooring arms thither comprise springs connected to adjacently positioned linked arm segments to facilitate deploying the anchor from the stowed position to an expanded, deployed position.

5. The mooring device of claim 1, further comprising an ejection guide to guide the mooring device from the deployment chamber during deployment.

6. The mooring device of claim 1, wherein the buoy has a ratio of length to width of greater than about 2:1 thereby reducing drag on the buoy when placed in a body of water.

7. The mooring device of claim 1, wherein the buoy has a lateral cross-section with a shape such that when the buoy is inflated with a gas, a higher percentage of the gas is in an upper half of the buoy and a lower percentage of the gas in a lower half of the buoy.

8. The mooring device of claim 7, wherein the mooring line module further comprises:

a mooring line spool positioned in a module housing wherein a mooring line is wound on the mooring line spool;

a line feed disk proximate to the mooring line spool; and a line locking mechanism configured to control release of the mooring line from the mooring line spool wherein the mooring line is released from the mooring line spool through the line feed disk.

9. The mooring device of claim 8, wherein the mooring line module further comprises a mooring line release system comprising:

a magnet coupled to the line feed disk; and a hall sensor wherein the line feed rotates as the mooring line is released from the mooring line module, and the hall sensor is configured to detect each rotation to determine an amount of the mooring line which is released.

10. The mooring device of claim 8, wherein the mooring line module further comprises a mooring line release system comprising:

a pressure sensor usable to determine depth of the mooring line module within a fluid.

11. The mooring device of claim 1, wherein the release mechanism for releasing an anchor comprises at least one chemical pill that dissolves in contact with water.

12. The mooring device of claim 1, further comprising an inflation system for inflating the buoy.

13. An autonomous mooring device comprising:

an anchor comprising a plurality of mooring arms rotatably coupled to a body of the anchor and biased to extend radially outward upon deployment from a deployment chamber above a sea floor, wherein each of the mooring arms comprise a plurality of spring biased, linked arm segments, the mooring arms being foldable at joints of the linked arm segments to enable the anchor to be folded into a stowed position and wherein the autonomous mooring device is separated from the deployment chamber upon deployment;

a mooring line module including a mooring line coupling the mooring line module to the anchor and a mooring line release system configured to periodically determine whether an amount of the mooring line extending from the mooring line module should be adjusted to keep the anchor in contact with the sea floor;

wherein the body of the anchor is coupled in close proximity to the mooring line module such that the plurality of arms may be rotated into a position in which the autonomous mooring device, including the plurality of arms, may be stored in the deployment chamber and upon release from the deployment chamber above the sea floor, rotate the mooring arms into a position such that the arms extend radially;

a release mechanism in communication with the anchor, wherein the release mechanism is configured to release the anchor from attachment in close proximity to the mooring line module upon contact with a water surface, whereby the anchor remains in contact with the mooring line module via the mooring line;

a flexible parachute coupled to the segments of the plurality of arms and extending between the arms at least partially circumferentially around the anchor to form a parachute usable to reduce the velocity of the autonomous mooring device after being dropped in air above a water body and wherein the flexible parachute is capable of remaining attached to the arm segments when the arm segments are rotated relative to each other to be placed into the stowed position; and a buoy in communication with the mooring line module via buoy line.

14. The mooring device of claim 13, wherein the mooring device is operable between a plurality of operational states comprising:

a first operational state wherein the anchor is in a stowed position, and the anchor, the mooring line module and the buoy in a deflated state, are contained within the deployment chamber, which is a cylinder;

a second operational state wherein the anchor, the mooring module and the buoy are deployed from the cylinder, the anchor, mooring line module and buoy are all rigidly attached, and the anchor is in an expanded operational position to effectuate air braking; and a third operational state wherein the anchor, mooring module and buoy are deployed, further wherein the buoy is attached to the mooring module including a first cable and the mooring module is attached to the anchor including a second cable, and the buoy is inflated to be buoyant.

15. The mooring device of claim 13, further comprising an ejection guide configured to guide the mooring device from the deployment chamber during deployment.

16. The mooring device of claim 13, wherein the buoy has a ratio of length to width of greater than about 2:1 thereby reducing drag on the buoy when placed in a body of water.

17. The mooring device of claim 13, wherein the buoy has a lateral cross-section with a shape such that when the buoy is inflated with a gas, a higher percentage of the gas is in an upper half of the buoy and a lower percentage of the gas in a lower half of the buoy.

18. The mooring device of claim 13, wherein the mooring line module further comprises a mooring line spool positioned in a module housing wherein a mooring line is wound on the mooring line disk; a line feed disk in communication with the mooring line spool; and a line locking mechanism configured to control release of the mooring line from the mooring line spool, wherein the mooring line is released from the mooring line spool through the line feed disk.

19. The mooring device of claim 13, wherein the mooring line release system comprises magnet coupled to a line feed disk and a hall sensor, wherein the line feed disk rotates as the mooring line is released from the mooring line module, and the hall sensor is configured to detect each rotation to determine an amount of the mooring line which is released.

20. The mooring device of claim 13, wherein the release mechanism for releasing an anchor comprises at least one chemical pill that dissolves when in contact with water.

* * * * *

UNITED STATES PATENT AND TRADEMARK OFFICE

CERTIFICATE OF CORRECTION

PATENT NO. : 7,179,145 B2
APPLICATION NO. : 10/772479
DATED : February 20, 2007
INVENTOR(S) : Frederick R. Driscoll et al.

It is certified that error appears in the above-identified patent and that said Letters Patent is hereby corrected as shown below:

Claim 2, column 16, line 46, after “is” add --in--.
Claim 4, column 16, line 67, after “arms” replace “thither” with --further--.
Claim 8, column 17, line 22, after “spool” add --,--.
Claim 9, column 17, line 29, after “sensor” add --;--.

Signed and Sealed this

Tenth Day of April, 2007

JON W. DUDAS
*Director of the United States Patent and Trademark Office*